US006957634B2

(12) United States Patent
Chang

(10) Patent No.: US 6,957,634 B2
(45) Date of Patent: Oct. 25, 2005

(54) ENGINE VALVE ACTUATOR

(75) Inventor: David Y. Chang, Savoy, IL (US)

(73) Assignee: Caterpillar Inc., Peoria, IL (US)

( * ) Notice: Subject to any disclaimer, the term of this patent is extended or adjusted under 35 U.S.C. 154(b) by 14 days.

(21) Appl. No.: 10/263,799

(22) Filed: Oct. 4, 2002

(65) Prior Publication Data

US 2004/0065283 A1 Apr. 8, 2004

(51) Int. Cl.[7] ..... F01L 9/02

(52) U.S. Cl. ..... 123/90.12; 123/90.45; 123/90.46; 123/90.52

(58) Field of Search ..... 123/90.12, 90.44, 123/90.45, 90.46, 90.48, 90.52, 90.55, 321, 324; 251/48, 54; 92/85 B, 143

(56) References Cited

U.S. PATENT DOCUMENTS

| | | | | |
|---|---|---|---|---|
| 3,220,392 A | * 11/1965 | Cummins | ..... | 123/321 |
| 3,250,068 A | 5/1966 | Vulliamy | | |
| 4,424,790 A | 1/1984 | Curtil | | |
| 4,552,172 A | * 11/1985 | Krieger et al. | ..... | 137/484.6 |

(Continued)

FOREIGN PATENT DOCUMENTS

| | | |
|---|---|---|
| JP | 05106415 A2 | 4/1993 |
| JP | 2000120457 A | 4/2000 |
| JP | 2000145484 A | 5/2000 |
| WO | WO 98/02653 | 1/1998 |

OTHER PUBLICATIONS

Edwards et al., "The Potential of a Combined Miller Cycle and Internal EGR Engine for Future Heavy Duty Truck Applications," The Engineering Society for Advancing Mobility Land Sea Air and Space International, International Congress and Exposition, Feb. 23–26, 1998, pp. 1–19.

Obert, "Internal Combustion Engines and Air Pollution," Based on Internal Combustion Engines, Third Edition, 1973, pp. 612–614.

Challen et al., "Diesel Engine Reference Book, Section Edition," SAE International, 1999, pp. 75, 81, 84, 146, and 263–305.

Yorihiro Fukuzawa et al., "Development of High Efficiency Miller Cycle Gas Engine", Mitsubishi Heavy Industries, Ltd., Technical Review, vol. 38, No. 3, Oct. 2001, pp. 146–150.

Request for *Inter Partes* Reexamination Transmittal Form for U.S. Pat. No. 6,688,280, and Attachment to Request for Inter Parties Reexamination Transmittal Form, Sep. 17, 2004.

Request for *Inter Partes* Reexamination Transmittal Form for U.S. Pat. No. 6,651,618, and Attachment to Request for Inter Parties Reexamination Transmittal Form, Aug. 27, 2004.

http://www.mazda.com.au/corpora/209.html, Oct. 16, 2001, pp. 1–6.

*Primary Examiner*—Thomas Denion
*Assistant Examiner*—Ching Chang
(74) *Attorney, Agent, or Firm*—Finnegan, Henderson, Farabow, Garrett & Dunner

(57) ABSTRACT

An engine valve actuator for an internal combustion engine is provided. The engine valve actuator includes a housing having an opening and a first fluid passageway leading to the opening. An adjustment member is disposed in the housing and includes a protrusion that extends into the opening of the housing. A piston is disposed in the opening of the housing and has a bore adapted to receive the protrusion, a chamber, and a second fluid passageway that connects the bore with the chamber. The piston is adapted to move in a first direction relative to the housing in response to an introduction of pressurized fluid into the first fluid passageway. The piston moves in the first direction until the protrusion substantially withdraws from the bore. A push rod is operatively engaged with the piston such that movement of the piston in the first direction causes a corresponding movement of the push rod to thereby engage and open the engine valve.

22 Claims, 4 Drawing Sheets

U.S. PATENT DOCUMENTS 4,561,253 A 12/1985 Curtil
4,655,178 A 4/1987 Meneely
4,706,625 A 11/1987 Meistrick et al. ..... 123/321
4,815,423 A 3/1989 Holmer
4,974,566 A * 12/1990 LoRusso et al. ..... 123/308
5,158,048 A * 10/1992 Robnett et al. ..... 123/90.16
5,161,501 A * 11/1992 Hu ..... 123/324
5,408,979 A 4/1995 Backlund et al.
5,445,128 A 8/1995 Letang et al.
5,460,131 A 10/1995 Usko ..... 123/321
5,511,460 A 4/1996 Custer ..... 91/401
5,682,854 A 11/1997 Ozawa
5,809,964 A * 9/1998 Meistrick et al. ..... 123/321
5,829,397 A * 11/1998 Vorih et al. ..... 123/90.12
5,927,075 A 7/1999 Khair
6,026,786 A 2/2000 Groff et al.
6,082,328 A 7/2000 Meistrick et al.
6,170,441 B1 1/2001 Haldeman et al.
6,192,841 B1 2/2001 Vorih et al. ..... 123/90.12
6,209,516 B1 4/2001 Yamashita
6,237,551 B1 5/2001 Macor et al.
6,267,107 B1 7/2001 Ward
6,273,057 B1 8/2001 Schwoerer et al. ..... 123/321
6,273,076 B1 8/2001 Beck et al.
6,279,550 B1 8/2001 Bryant
6,301,887 B1 10/2001 Gorel et al.
6,301,889 B1 10/2001 Gladden et al.
6,302,076 B1 10/2001 Bredy
6,302,370 B1 10/2001 Schwoerer et al. ..... 251/48
6,467,452 B1 10/2002 Duffy et al.
6,571,765 B2 6/2003 Kuboshima et al.
6,651,618 B1 11/2003 Coleman et al.
6,668,773 B2 * 12/2003 Holtman et al. ..... 123/90.12
6,688,280 B2 2/2004 Weber et al.

* cited by examiner

ENGINE VALVE ACTUATOR

TECHNICAL FIELD

The present disclosure is directed to an engine valve actuator and, more particularly, the present disclosure is directed to a stroke limiter for an engine valve actuator.

BACKGROUND

A vehicle, such as, for example, an on or off highway truck, may include a compression release braking system that assists a conventional braking system in reducing the speed of the vehicle. The compression release braking system allows an internal combustion engine to convert the kinetic energy of the moving vehicle into compressed air in the combustion chambers of the engine. The compression release braking system releases the compressed air from the combustion chambers to the environment to thereby dissipate the kinetic energy of the moving vehicle and slow the vehicle.

A compression release braking system typically cooperates with a valve actuation system connected with the engine. The compression release braking system opens the exhaust valves of the engine when a piston associated with each combustion chamber is at or near a top-dead-center position of a compression stroke. Opening the exhaust valve allows the air compressed by the piston in the combustion chamber during the compression stroke to escape from the combustion chamber through an exhaust passageway. In this manner, the pistons of the engine are used as air compressors to absorb power instead of generating power in response to the combustion of fuel.

The compression release braking system may also operate in conjunction with a fuel delivery system. When an operator instructs the vehicle to slow down, such as, for example, by depressing a brake pedal, the fuel delivery system may stop delivering fuel to the combustion chambers. This will conserve fuel by preventing fuel from being exhausted from the combustion chambers with the release of compressed air. In addition, stopping fuel delivery during engine braking will prevent an inadvertent ignition of fuel during the combustion stroke before the exhaust valves are opened to release the compressed air.

A compression release braking system may operate with a conventional cam driven engine valve actuation system. The compression release braking system may include a hydraulically powered engine valve actuator that engages and opens an exhaust valve independently of the cam driven system. The compression release braking system may also include a directional control valve that controls a flow of pressurized fluid to the piston to coordinate the opening of the exhaust valves with the movement of the piston.

The amount of movement of each exhaust valve should be controlled to prevent damage to the exhaust valve. If the engine valve actuator moves the exhaust valve too far into the combustion chamber, the exhaust valve may come into contact with the piston, which will be approaching the exhaust valve as it nears a top-dead-center position during the compression stroke. Contact between the exhaust valve and the piston can result in damage to the exhaust valve, which may detract from engine performance when conventional engine operation is resumed.

To prevent damage to the exhaust valves, an engine valve actuator may be configured to limit the amount of motion of the hydraulically powered piston to thereby limit the amount of motion of the exhaust valve. For example, as shown in U.S. Pat. No. 5,161,501 to Hu, the travel distance of a piston in an engine valve actuator may be limited by opening a fluid escape passage in the actuator housing after the piston has moved through a certain distance. The fluid escape passageway allows the release of the pressurized fluid that is driving the piston to thereby decrease the force acting on the piston. Therefore, the piston will stop moving when the fluid escape passageway is opened.

However, the engine valve actuator described in U.S. Pat. No. 5,161,501 requires precise positioning relative to the engine valve. The travel distance of the piston is limited by the fluid passageway in the brake housing. Accordingly, the actuator housing must be positioned in sufficient proximity to the engine valve to ensure that the piston will engage and open the exhaust valve before the fluid escape passageway is opened. Thus, the compression release braking system described in U.S. Pat. No. 5,161,501 to Hu is relatively inflexible and does not provide for individual valve actuator adjustment.

The engine valve actuator of the present disclosure solves one or more of the problems set forth above.

SUMMARY OF THE INVENTION

In one aspect, the present disclosure is directed to an engine valve actuator for an internal combustion engine that includes a housing having an opening and a first fluid passageway leading to the opening. An adjustment member is disposed in the housing and includes a protrusion that extends into the opening of the housing. A piston is disposed in the opening of the housing and has a bore adapted to receive the protrusion, a chamber, and a second fluid passageway that connects the bore with the chamber. The piston is adapted to move in a first direction relative to the housing in response to an introduction of pressurized fluid into the first fluid passageway. The piston moves in the first direction until the protrusion substantially withdraws from the bore. A push rod is operatively engaged with the piston such that movement of the piston in the first direction causes a corresponding movement of the push rod to thereby engage and open the engine valve.

In another aspect, the present disclosure is directed to a method of limiting the stroke of an actuator piston associated with an engine valve of an internal combustion engine. Pressurized fluid is provided to a housing that defines an opening and has a protrusion extending into the opening. The pressurized fluid is directed through the opening to a piston adapted to operatively engage an engine valve. The piston has a bore adapted to receive the protrusion. The pressurized fluid acts on the piston to move the piston relative to the housing to thereby open the engine valve. The pressurized fluid is allowed to flow from the opening in the housing through a fluid passageway connecting the bore of the piston with a chamber in the piston to thereby limit the movement of the piston.

DETAILED DESCRIPTION

Figure 1:
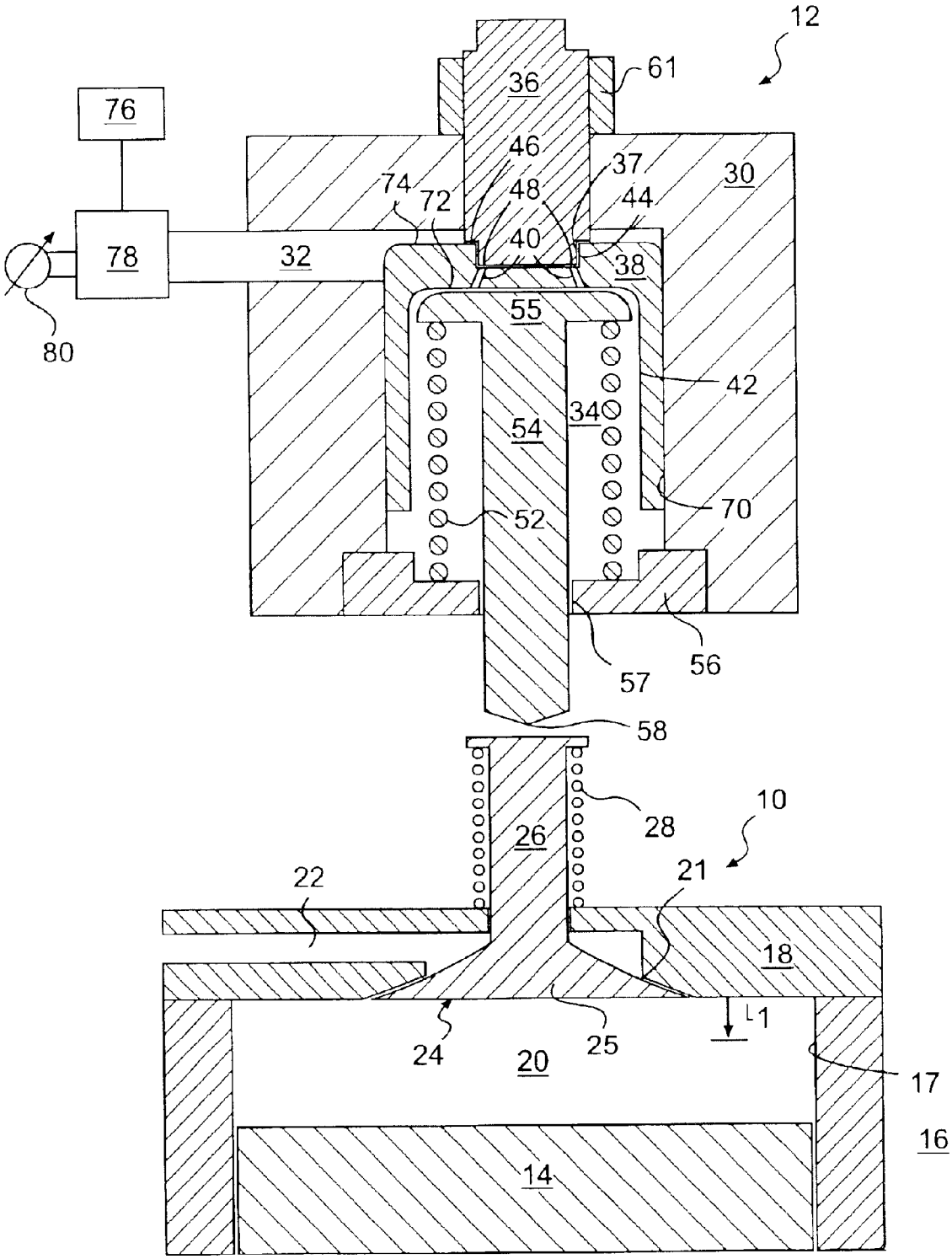
FIG. 1 is a schematic and diagrammatic cross-sectional representation of a compression release braking system for an internal combustion engine in accordance with an exemplary embodiment of the present invention.

An exemplary embodiment of an engine valve actuator 12 for an internal combustion engine 10 is illustrated in FIG. 1. Engine 10 includes an engine block 16 having a cylinder 17 that defines a combustion chamber 20. A cylinder head 18 may be engaged with engine block 16 to cover cylinder 17.

As also shown, a piston 14 may be disposed within cylinder 17. Piston 14 is adapted to reciprocate between a bottom-dead-center position and a top-dead-center position within cylinder 17. Piston 14 may be connected to a crankshaft (not shown) such that a rotation of the crankshaft causes piston 14 to reciprocate between the bottom-dead-center position and the top-dead-center position in cylinder 17. In addition, a reciprocating movement of piston 14 between the bottom-dead-center position and the top-dead-center position within cylinder 17 will cause a corresponding rotation of the crankshaft.

Engine 10 may, for example, operate in a conventional four stroke diesel cycle. In a four stroke diesel cycle, piston 14 moves through an intake stroke, a compression stroke, a combustion stroke, and an exhaust stroke. One skilled in the art will recognize that engine 10 may operate in other known operating cycles, such as, for example, an Otto cycle.

As also illustrated in FIG. 1, cylinder head 18 defines an opening 21 that leads to a passageway 22. For the purposes of the present disclosure, opening 21 and passageway 22 will be referred to as an exhaust opening and an exhaust passageway. One skilled in the art will recognize, however, that opening 21 and passageway 22 may also be an intake opening and an intake passageway.

Cylinder head 18 may define one or more additional exhaust openings as well as one or more intake openings and passageways that lead to and/or from combustion chamber 20. Exhaust passageway 22 may connect combustion chamber 20 with an exhaust manifold (not shown). An intake passageway may connect combustion chamber 20 with an intake manifold (not shown).

An engine valve 24 may be disposed in exhaust opening 22. For the purposes of the present disclosure, engine valve 24 will be referred to as an exhaust valve. One skilled in the art will recognize, however, that engine valve 24 may also be an intake valve.

Exhaust valve 24 may include a valve stem 26 and a valve element 25. Exhaust valve 24 may be moved between a first position and a second position. In the first position, exhaust valve 24 blocks exhaust opening 21 to prevent a flow of fluid from combustion chamber 20 to exhaust passageway 22. In the second position exhaust valve 24 allows fluid to flow from combustion chamber 20 to exhaust passageway 22.

A valve actuation system (not shown) may be provided to actuate exhaust valve 24. As one skilled in the art will recognize, the valve actuation system may be a cam-driven system, a hydraulically driven system, an electrically driven system, or a combination thereof. The valve actuation system may be adapted to exert a force on valve stem 26 to thereby move exhaust valve 24 from the first position to the second position. A valve return spring 28 may be engaged with valve stem 26 to return exhaust valve 24 to the first position when the force exerted by the valve actuation system is removed.

The valve actuation system may be adapted to coordinate the opening of exhaust valve 24 with the movement of piston 14. For example, the valve actuation system may open exhaust valve 24 when piston 14 is moving through an exhaust stroke. In this manner, exhaust gases created during the combustion of fuel in combustion chamber 20 may be exhausted to exhaust passageway 22.

Engine 10 may also include a fuel injection system (not shown). The fuel injection system may deliver, for example, diesel fuel, gasoline, or natural gas to combustion chamber 20. The fuel injection system may be configured to inject a certain quantity of fuel into combustion chamber 20 at a certain point in the operating cycle of engine 10. For example, the fuel injection system may inject a quantity of diesel fuel into combustion chamber 20 as piston 14 moves from a top-dead-center position towards a bottom-dead-center position during an intake stroke.

As also shown in FIG. 1, valve actuator 12 includes a housing 30. Housing 30 defines a fluid passageway 32 and an opening 34. A source of pressurized fluid 80, which may be, for example, a variable capacity pump, may supply a flow of pressurized fluid to opening 34 through fluid passageway 32. A control valve 78 may be disposed in fluid passageway 32 to control the rate of fluid flow through fluid passageway 32.

Figure 2:
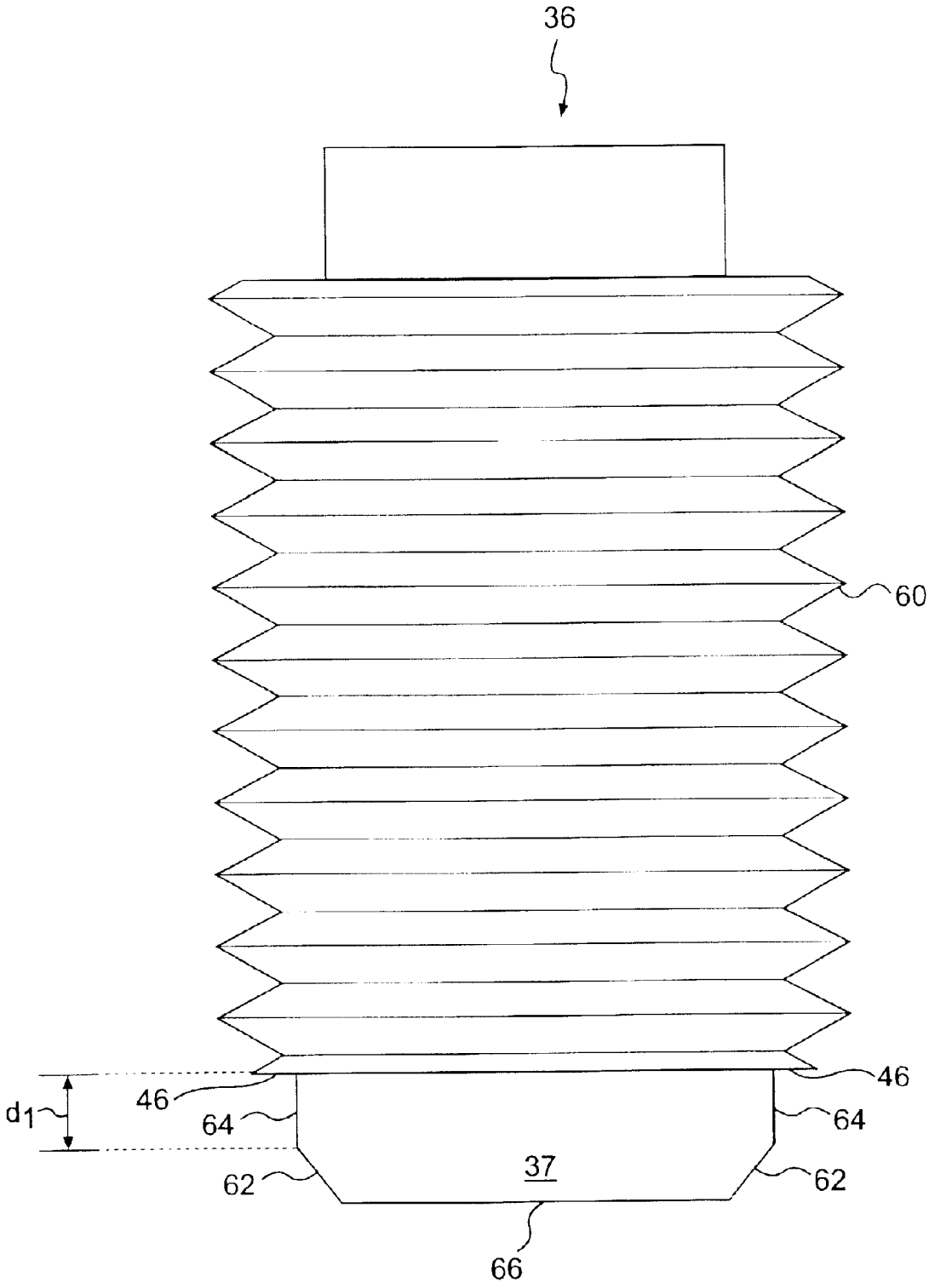
FIG. 2 is a side view of an adjustment member in accordance with an exemplary embodiment of the present invention.

An adjustment member 36 may be disposed in housing 30. As shown in FIG. 2, adjustment member 36 includes a protrusion 37 that extends from a shoulder 46. Protrusion 37 includes a side wall 64 and a surface 66. Protrusion 37 may also include a chamfered edge 62.

Adjustment member 36 and housing 30 may be adapted to allow the distance that protrusion 37 extends into opening 34 to be adjusted. For example, as shown in FIG. 2, the outer surface of adjustment member 36 may include threads 60 that are configured to engage corresponding threads in housing 30. Adjustment member 36 may be rotated to thereby adjust the position of adjustment member 36 relative to housing 30. One skilled in the art will recognize that the position of adjustment member 36 relative to housing 30 may be adjusted through other known methods and/or devices, such as, for example, a spring-loaded ball and detent mechanism.

As shown in FIG. 1, a nut 61 may be engaged with the threads of adjustment member 36. When adjustment member 36 is properly positioned with respect to housing 30, nut 61 may be tightened to engage housing 30. In this manner, further movement of adjustment member 36 relative to housing 30 may be prevented.

Figure 3:
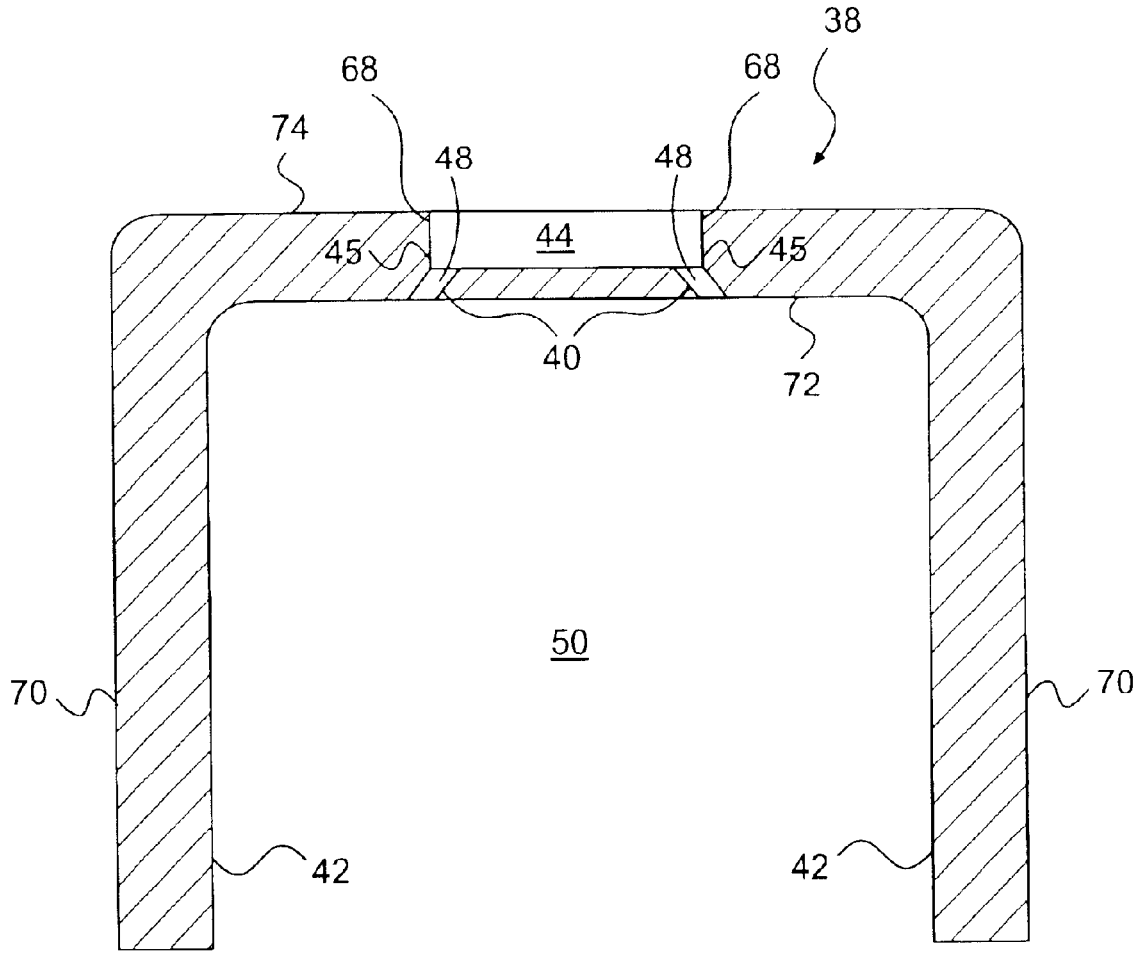
FIG. 3 is a side sectional view of a piston in accordance with an exemplary embodiment of the present invention.
Figure 4:
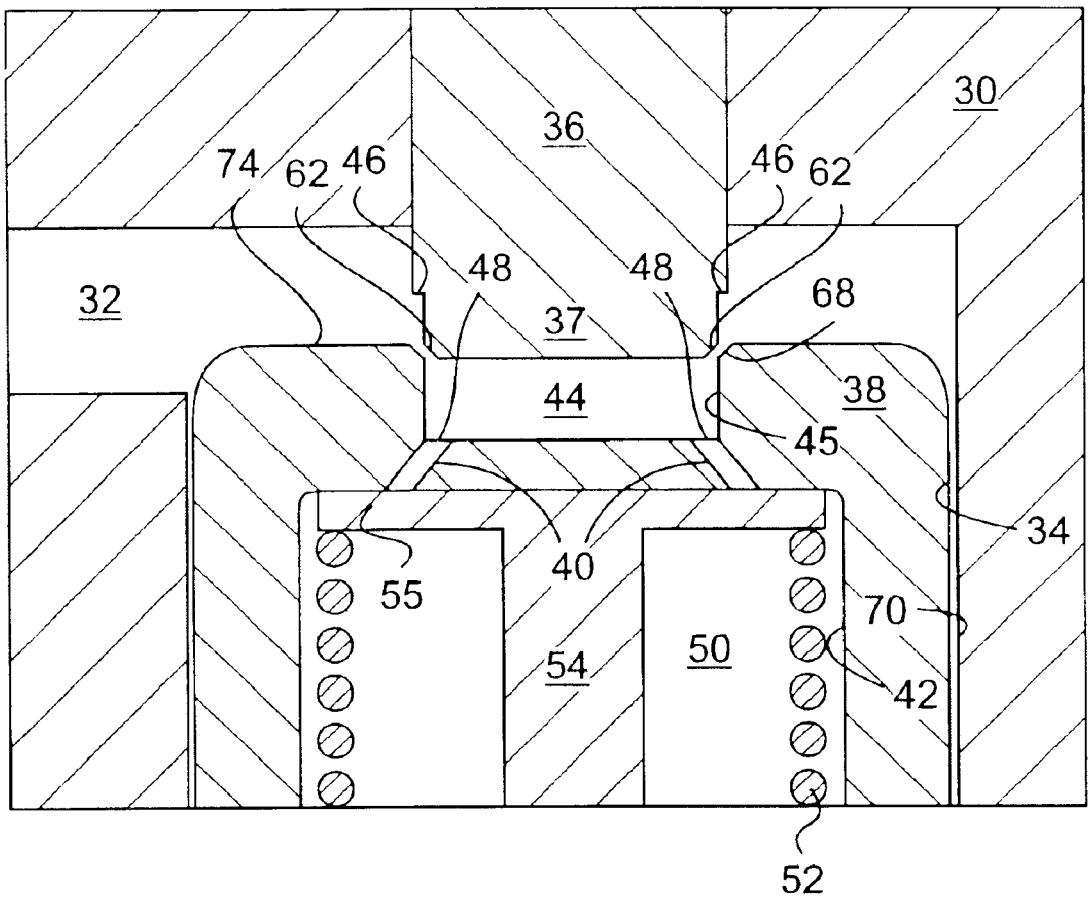
FIG. 4 is a schematic and diagrammatic cross-sectional representation of an exemplary embodiment of a compression release braking system in an open position.

Valve actuator 12 also includes a piston 38, which may be, for example, a slave piston. As shown in FIGS. 3 and 4, piston 38 includes a pressure surface 74 and an outer surface 70. Piston 38 also includes an inner surface 42 and a contact surface 72 that define a chamber 50.

As also shown in FIG. 3, piston 38 also includes a bore 44 formed in pressure surface 74. Bore 44 may include a chamfered edge 68 and a sidewall 45. Piston 38 also includes one or more fluid passageways 40 that lead from an opening 48 in bore 44 to chamber 50.

As shown in FIGS. 1 and 4, piston 38 may be slidably disposed in opening 34 of housing 30. Outer surface 70 of piston 38 may be adapted for a close tolerance fit with opening 34. In addition, a seal (not shown) may be disposed between outer surface 70 of piston 38 and housing 30.

As also shown in FIG. 1, bore 44 of piston 38 is adapted to receive protrusion 37 of adjustment member 36. Bore 44 and protrusion 37 may also be adapted for a close tolerance fit. A seal (not shown) may also be disposed between bore 44 and protrusion 37. Thus, when protrusion 37 is disposed in bore 44, pressurized fluid is prevented from flowing between sidewall 64 of protrusion 37 and sidewall of 45 of bore 44.

As shown in FIG. 1, a push rod 54 may be disposed in chamber 50 of piston 38. Push rod 54 includes a head 55 that is adapted to engage contact surface 72 of piston 38 and an end 58 that extends from housing 30. Push rod 54 may be adapted to move relative to housing 30 in response to a corresponding movement of piston 38. One skilled in the art will recognize that push rod 54 and piston 38 may be formed as a single piece or as separate pieces.

Valve actuator 12 may also include a plate 56 that engages housing 30 to cover opening 34. Plate 56 may include an opening 57 that is configured to slidably receive push rod 54. Plate 56 may also include drain openings (not shown) that, as will be discussed in greater detail below, allow fluid to drain from housing 30.

As further shown in FIG. 1, a piston return spring 52 may be disposed in housing 30. Piston return spring 52 may act between plate 56 and head 55 of push rod 54. Piston return spring 52 acts to move push rod 54 and piston 38 to engage protrusion 37 with bore 44 until a portion of pressure surface 74 engages shoulder 46 of adjustment member 36.

As also shown in FIG. 1, a controller 76 may be connected to control valve 78. Controller 76 may be an electronic control module that includes a microprocessor and memory. As is known to those skilled in the art, the memory may be connected to the microprocessor and may store an instruction set and variables. Associated with the microprocessor and part of the electronic control module may be various other known circuits such as, for example, power supply circuitry, signal conditioning circuitry, and solenoid driver circuitry, among others.

As one skilled in the art will recognize, controller 76 may be programmed to control one or more aspect of the operation of engine 10. For example, controller 76 may be programmed to control the position of control valve 78, the operation of source of pressurized fluid 80, and the operation of the fuel injection system (not shown).

INDUSTRIAL APPLICABILITY

Engine 10 may be operated to provide power to propel a vehicle, such as, for example, an automobile, an on-highway truck, or an off-highway truck. Engine 10 may be operated in a conventional four stroke diesel cycle. For the purposes of the present disclosure, the operation of a single cylinder 20 of engine 10 will be described.

During a conventional operation cycle of engine 10, piston 14 moves from a top-dead-center position towards a bottom-dead-center position in an intake stroke. As piston 14 moves through the intake stroke, the engine valve actuation system opens an intake valve (not shown) associated with combustion chamber 20. The opening of the intake valve allows intake air to flow from an intake manifold (not shown) into combustion chamber 20. The intake air may be at ambient pressure or the intake air may be pressurized such as, for example, by a turbocharger.

A fuel injection system injects a quantity of fuel during the intake stroke of piston 14. The fuel may be injected directly into combustion chamber 20 or into the intake manifold. The fuel mixes with the intake air to form a combustible mixture.

Piston 14 then moves from the bottom-dead-center position towards the top-dead-center position of a combustion stroke. The movement of piston 14 within combustion chamber 20 compresses the air and fuel mixture. Engine 10 may be adapted so that piston 14 compresses the air and fuel mixture to reach the critical, or combustion, pressure when piston 14 is at or near the top-dead-center position of the compression stroke.

When the fuel and air mixture reaches the critical pressure, the fuel ignites and the mixture is combusted. The combustion of the fuel and air mixture drives piston 14 towards the bottom-dead-center position in a combustion stroke. The driving power of the fuel combustion is translated into an output rotation of a crankshaft (not shown) that is used to propel the vehicle.

Piston 14 then returns from the bottom-dead-center position to the top-dead-center position in an exhaust stroke. During the exhaust stroke, the engine valve actuation system moves exhaust valve 24 towards the second position to create a fluid passageway from combustion chamber 20 to exhaust passageway 22. The movement of piston 14 towards the top-dead-center position forces combustion exhaust from combustion chamber 20 into exhaust passageway 22. The operating cycle of piston 14 may then begin again with another intake stroke.

When a vehicle operator provides an instruction to decelerate the vehicle, such as, for example, by depressing a brake pedal, the engine may operate in an "engine braking" mode. Controller 76 may instruct the fuel delivery system to cease delivery of fuel to combustion chambers 20. The controller may also operate control valve 78 to activate valve actuator 12 to assist in the deceleration of the vehicle.

In the "engine braking" mode, controller opens control valve 78 to allow pressurized fluid to flow from source of pressurized fluid 80 through fluid passageway 32 into opening 34. The pressurized fluid exerts a force on pressure surface 74 of piston 38, which causes piston 38 to move within housing 30. The movement of piston 38 causes a corresponding movement of push rod 54.

As push rod 54 moves relative to housing 30, end 58 of push rod 54 will engage exhaust valve 24. Push rod 54 may directly engage valve stem 26. Alternatively, push rod 54 may engage another portion of exhaust valve 24 or an operative portion of the valve actuation system such as, for example, a bridge connecting a pair of exhaust valves 24 for combustion chamber 20.

The continued movement of piston 38 and push rod 54 after end 58 engages exhaust valve 24 causes exhaust valve 24 to move from the first position towards the second position to allow a flow of fluid from combustion chamber 20 to exhaust passageway 22. Controller 76 may control the opening of control valve 78 so that exhaust valve 24 opens when piston 14 is at or near the top-dead-center position of the compression stroke.

When exhaust valve 24 is opened at this point in the operating cycle, the air compressed by piston 14 escapes from combustion chamber 20 through exhaust passageway 22. The act of compressing air will act to oppose the motion of the crankshaft. Because the air compression does not result in fuel combustion, the piston is not driven through a combustion stroke. Thus, valve actuator 12 causes engine 10 to operate as an air compressor that absorbs the kinetic energy of the moving vehicle by opposing the rotation of the crankshaft. Valve actuator 12 will, therefore, assist in the slowing of the moving vehicle.

The travel distance of exhaust valve 24 is limited by the height of protrusion 37 (indicated in FIG. 2 by $d_1$). Piston 38 and push rod 54 will continue to move within housing 30 until protrusion 37 starts to withdraw from bore 40. Protrusion 37 will begin to withdraw from bore 44 after piston 38 moves through the distance $d_1$.

As shown in FIG. 4, when protrusion 37 substantially withdraws from bore 40, a gap is created between side wall 64 of protrusion 37 and side wall 45 of bore 44 and pressurized fluid is allowed to flow through fluid passageways 40 into chamber 50. The release of fluid to chamber 50 will reduce the magnitude of the force exerted on piston 38. When the magnitude of the force exerted by the pressurized fluid decreases to be substantially equal to or less than the force exerted on piston 38 by piston return spring 52, piston 38 will stop moving. If the force of piston return spring 52 is greater than the force of the pressurized fluid on pressure surface, piston return spring 52 will move piston 38 towards adjustment member 36.

Chamfered edges 62 and 68 of protrusion 37 and bore 44 may facilitate the formation of the gap between side wall 64 of protrusion 37 and side wall 45 of bore 44. With chamfered edges 62 and 68, the gap will be formed before protrusion 37 completely withdraws from bore 44. This will also ensure that protrusion 37 remains aligned with bore 44 so that protrusion 37 may easily re-engage bore 44 when piston return spring 52 moves piston 38 towards adjustment member 36.

The end position of push rod 54 relative to housing 30, which corresponds to the lift distance (identified as $L_1$ in FIG. 1) of exhaust valve 24, may be adjusted by re-positioning adjustment member 36 relative to housing 30. By adjusting threads 60 of adjustment member 26 to move protrusion 37 towards exhaust valve 24, the lift distance $L_1$ of exhaust valve 24 may be increased. By adjusting threads 60 of adjustment member 26 to move protrusion 37 away from exhaust valve 24, the lift distance $L_1$ of exhaust valve 24 may be decreased. Thus, valve actuator 12 allows for easy adjustment of the lift distance $L_1$ of exhaust valve 24 to prevent valve element 25 of exhaust valve 24 from contacting piston 14 and damaging valve element 25.

When, controller 76 closes control valve 78 to stop the flow of fluid to opening 34, piston return spring 52 will act on push rod 54 and piston 38 to re-engage bore 44 of piston 38 with protrusion 37 of adjustment member 36. Chamfered edges 62 and 68 of adjustment member 36 and piston 38, respectively, may assist in aligning protrusion 37 with bore 44.

As will be apparent from the foregoing description, the present disclosure provides an engine valve actuator that has a limited travel distance. The described valve actuator may be easily adjusted to change the travel distance, or lift, of the associated engine valve. The valve actuator may, therefore, be installed on an engine and adjusted to control the amount of lift provided to an engine valve during an operation, such as, for example, engine braking. In this manner, damage to the engine valves may be prevented.

It will be apparent to those skilled in the art that various modifications and variations can be made in the engine valve actuator of the present invention without departing from the scope of the disclosure. Other embodiments of the engine valve actuator will be apparent to those skilled in the art from consideration of the specification and practice of the valve actuator disclosed herein. It is intended that the specification and examples be considered as exemplary only, with a true scope of the disclosure being indicated by the following claims and their equivalents.

What is claimed is:

1. An engine valve actuator for an internal combustion engine, comprising:

a housing having an opening and a first fluid passageway leading to the opening;

an adjustment member disposed in the housing and including a protrusion extending into the opening of the housing;

a piston disposed in the opening of the housing and having a bore adapted to receive the protrusion, a chamber, and a second fluid passageway connecting the bore with the chamber, the piston adapted to move in a first direction relative to the housing in response to an introduction of pressurized fluid into the first fluid passageway, the piston moving in the first direction until the protrusion substantially withdraws from the bore; and a push rod operatively engaged with the piston such that movement of the piston in the first direction causes a corresponding movement of the push rod to thereby engage and open the engine valve; and a piston return spring acting on the piston to move the piston into engagement with the protrusion, wherein the piston return spring and the push rod are disposed in the chamber of the piston.

2. The engine valve actuator of claim 1, wherein the protrusion of the adjustment member includes a chamfered edge.

3. The engine valve actuator of claim 2, wherein the bore of the piston includes a chamfered edge.

4. The engine valve actuator of claim 1, wherein the piston includes a pressure surface and the adjustment member includes a shoulder adapted to engage a portion of the pressure surface.

5. The engine valve actuator of claim 1, wherein the adjustment member and the housing include corresponding threads that allow the adjustment member to be moved relative to the housing to adjust the distance that the protrusion projects into the opening.

6. The engine valve actuator of claim 5, further including a nut engageable with the threads of the adjustment member to secure the adjustment member relative to the housing.

7. An engine, comprising:

an engine block defining a cylinder;

a piston slidably disposed in the cylinder;

an engine valve moveable between a first position where a flow of fluid relative to the engine valve is prevented and a second position where a flow of fluid relative to the engine valve is allowed;

a housing having a first fluid passageway leading to an opening;

an adjustment member disposed in the housing and having a protrusion extending into the opening of the housing;

a piston disposed in the opening of the housing and having a bore adapted to receive the protrusion, a chamber, and a second fluid passageway connecting the bore with the chamber, the piston adapted to move in a first direction relative to the housing in response to an introduction of pressurized fluid into the first fluid passageway, the piston moving in the first direction until the protrusion substantially withdraws from the bore; and a push rod operatively engaged with the piston such that movement of the piston in the first direction causes a corresponding movement of the push rod to thereby engage and move the engine valve towards the second position.

a piston return spring acting on the piston to move the piston into engagement with the protrusion, wherein the piston return spring and the push rod are disposed in the chamber of the piston.

8. The engine of claim 7, further including a valve return spring acting to move the engine valve towards the first position.

9. The engine of claim 7, wherein the protrusion of the adjustment member includes a chamfered edge.

10. The engine of claim 9, wherein the bore of the piston includes a chamfered edge.

11. The engine of claim 7, wherein the piston includes a pressure surface and the adjustment member includes a shoulder adapted to engage a portion of the pressure surface.

12. The engine of claim 7, wherein the adjustment member and the housing include corresponding threads that allow the adjustment member to be moved relative to the housing to adjust the distance that the protrusion projects into the opening.

13. The engine of claim 12, further including a nut engageable with the threads of the adjustment member to secure the adjustment member relative to the housing.

14. An engine valve actuator for an internal combustion engine, comprising:

a housing having an opening and a first fluid passageway leading to the opening;

an adjustment member disposed in the housing and including a protrusion extending into the opening of the housing;

a variable displacement pump fluidly connected to the first fluid passageway;

a control valve disposed between the pump and the first fluid passageway, the control valve having a first position where fluid flows relative to the control valve and a second position where fluid is blocked from flowing relative to the control valve;

a piston disposed in the opening of the housing and having a bore adapted to receive the protrusion, a chamber, and a second fluid passageway connecting the bore with the chamber, the piston adapted to move in a first direction relative to the housing in response to a flow of fluid through the control valve, the piston moving in the first direction until the protrusion substantially withdraws from the bore, wherein the piston includes a pressure surface and the adjustment member includes a shoulder adapted to engage a portion of the pressure surface;

a piston return spring acting on the piston to move the portion of the pressure surface into engagement with the shoulder; and a push rod operatively engaged with the piston such that movement of the piston in the first direction causes a corresponding movement of the push rod to thereby engage and open the engine valve, wherein the piston return spring and the push rod are disposed in the chamber of the piston.

15. The engine valve actuator of claim 14, further including a controller in communication with the control valve and operable to cause movement of the control valve between the first and second positions.

16. The engine valve actuator of claim 14, wherein the adjustment member and the housing include corresponding threads that allow the adjustment member to be moved relative to the housing to adjust the distance that the protrusion projects into the opening.

17. The engine valve actuator of claim 16, further including a nut engageable with the threads of the adjustment member to secure the adjustment member relative to the housing.

18. An engine, comprising:

an engine block defining a cylinder;

a piston slidably disposed in the cylinder;

an engine valve moveable between a first position where a flow of fluid relative to the engine valve is prevented and a second position where a flow of fluid relative to the engine valve is allowed;

a housing having a first fluid passageway leading to an opening;

an adjustment member disposed in the housing and having a protrusion extending into the opening of the housing;

a variable displacement pump fluidly connected to the first fluid passageway;

a control valve disposed between the pump and the first fluid passageway, the control valve having a first position where fluid flows relative to the control valve and a second position where fluid is blocked from flowing relative to the control valve;

a piston disposed in the opening of the housing and having a bore adapted to receive the protrusion, a chamber, and a second fluid passageway connecting the bore with the chamber, the piston adapted to move in a first direction relative to the housing in response to a flow of fluid through the control valve, the piston moving in the first direction until the protrusion substantially withdraws from the bore, wherein the piston includes a pressure surface and the adjustment member includes a shoulder adapted to engage a portion of the pressure surface;

a piston return spring acting on the piston to move the portion of the pressure surface into engagement with the shoulder; and a push rod operatively engaged with the piston such that movement of the piston in the first direction causes a corresponding movement of the push rod to engage and move the engine valve towards the second position, wherein the piston return spring and the push rod are disposed in the chamber of the piston.

19. The engine of claim 18, further including a controller in communication with the control valve and configured to control the movement of the control valve between the first and second positions.

20. The engine of claim 18, further including a valve return spring acting to move the engine valve towards the first position.

21. The engine of claim 18, wherein the adjustment member and the housing including corresponding threads that allow the adjustment member to be moved relative to the housing to adjust the distance that the protrusion projects into the opening.

22. The engine of claim 21, further including a nut engageable with the threads of the adjustment member to secure the adjustment member relative to the housing.

* * * * *